US010844873B2

(12) United States Patent
Preis

(10) Patent No.: US 10,844,873 B2
(45) Date of Patent: Nov. 24, 2020

(54) INDUSTRIAL FAN HOUSING ASSEMBLY WITH REPLACEABLE SCROLL

(71) Applicant: AirStream Research Inc., Waterloo (CA)

(72) Inventor: Fred Preis, Waterloo (CA)

(73) Assignee: AirStream Research Inc., Ontario ( * ) Notice: Subject to any disclaimer, the term of this patent is extended or adjusted under 35 U.S.C. 154(b) by 107 days.

(21) Appl. No.: 15/909,696

(22) Filed: Mar. 1, 2018

(65) Prior Publication Data

US 2019/0271327 A1 Sep. 5, 2019

(51) Int. Cl.

| | |
|---|---|
| ***F04D 29/42*** | (2006.01) |
| ***F04D 29/60*** | (2006.01) |
| ***F04D 29/08*** | (2006.01) |
| ***F04D 29/62*** | (2006.01) |

(52) U.S. Cl.
CPC ..... *F04D 29/4226* (2013.01); *F04D 29/083* (2013.01); *F04D 29/424* (2013.01); *F04D 29/60* (2013.01); *F04D 29/626* (2013.01)

(58) Field of Classification Search
CPC ..... F04D 29/40; F04D 29/403; F04D 29/42; F04D 29/4206; F04D 29/4226; F04D 29/4266; F04D 29/4286; F04D 29/60; F04D 29/083
See application file for complete search history.

(56) References Cited

U.S. PATENT DOCUMENTS

| | | | | |
|---|---|---|---|---|
| 1,462,890 A * | 7/1923 | Taylor | F03B 3/186 415/204 |
| 1,587,876 A * | 6/1926 | Tolliver | F04D 29/4226 415/204 |
| 3,619,080 A * | 11/1971 | Bullock | F04D 29/424 415/206 |
| 4,120,605 A * | 10/1978 | Hurst | E02F 3/90 415/197 |
| 5,690,470 A * | 11/1997 | Zimmer | F04D 29/424 415/214.1 |
| 6,443,514 B1 * | 9/2002 | Fuller | B66C 1/66 294/215 |

* cited by examiner

*Primary Examiner* — Courtney D Heinle
*Assistant Examiner* — Michael K. Reitz
(74) *Attorney, Agent, or Firm* — Tai W. Nahm; Miller Thomson LLP

(57) ABSTRACT

There is disclosed an industrial fan housing assembly, comprising: a plurality of scroll-liner sections configured to be assembled together to form a midsection of the industrial fan housing assembly, each scroll-liner section including a liner; wherein, each scroll-liner section includes side flanges to assemble the section to first and second fan housing scroll sideplates on either side. In an embodiment, at least two of the plurality of scroll-liner sections are identical and interchangeable, thereby allowing the identical and interchangeable sections to be assembled in one of a plurality of positions. Advantageously, the scroll-liner sections may be installed without welding or cutting, and may be individually removed for servicing or replaced when the lining is worn. The cost for operating and servicing and the fan housing assembly is significantly reduced.

17 Claims, 7 Drawing Sheets

INDUSTRIAL FAN HOUSING ASSEMBLY WITH REPLACEABLE SCROLL

FIELD OF THE INVENTION

The present disclosure relates generally to industrial fan housing assemblies.

BACKGROUND OF THE INVENTION

Industrial fan housing assemblies used in certain types of heavy industrial applications, such as cement, steel, pulp and paper, and power generation, can range in size from a few feet across to over 30 feet in height and in width, with motors ranging from approximately 250 hp to 8000 hp or more. For larger fan housing assemblies, their sheer size typically requires on-site assembly and maintenance.

Conventional fan housing assemblies are typically assembled with welded joints and bolted fasteners, which make access for maintenance difficult. Furthermore, in order to replace a worn part, the fan housing assembly may need to be taken off service for a lengthy period of time, and access to service inner parts may only be possible through confined spaces, potentially causing safety issues.

Therefore, what is needed is an improved industrial fan housing assembly which overcomes at least some of the limitations in the prior art.

SUMMARY OF THE INVENTION

The present disclosure relates generally to industrial fan housing assemblies, and more particularly to industrial fan housing assemblies having removable scroll-liner sections which may be installed onto correspondingly sized and shaped fan housing scroll side plates or rims.

In an embodiment, each scroll-liner section comprises a generally curved plate having edge flanges on either side. The edge flanges include a plurality of apertures which are aligned with corresponding apertures provided on the fan housing scroll sideplates. Each scroll-liner section may therefore be bolted onto the rims using a plurality of suitably sized bolts.

As each scroll-liner section may be over 10 feet across and over 15 feet along the length of the fan housing scroll sideplates on its curved sides, each scroll-liner section also includes a plurality of attachment points for moving these scroll-liner sections into position with powered overhead lifting equipment.

In order to create at least a partial air seal between each scroll-liner section and the rims, a continuous seal is fitted at the location where each scroll-liner section attaches to the fan housing scroll sideplates.

As each scroll-liner section is installed and removed individually by bolting each section to the sideplates, the sections do not require welding and/or cutting.

Advantageously, the fan housing assembly comprises easily removable sections which allow access to the inner of the fan housing, and therefore provides a safer working environment by avoiding confined space entry.

Furthermore, as sections do not need to be welded, the use of hot welding or torching tools is not required to complete maintenance.

Because the scroll-liner sections can be removed completely from the exterior of the fan housing (enclosure), the fan rotor does not need to be removed, as is the case for certain types of interior maintenance.

Whereas existing fan housing liners may be repaired in situ only, or replaced by cutting and welding, with the current invention, each scroll-liner section has a liner built into the section, such that liners do not need to be removed from inside the fan housing. This greatly reduces the time required to remove and replace worn or damaged linings. This facilitates maintenance during more frequently available short-duration plant outages. The advantage of this is significantly reduced production down-time for maintenance, and timely maintenance of components when required instead of allowing parts to wear out because of the need to wait until longer outage times can be scheduled.

In another aspect, whereas existing fan housing liners are curved with variable or multiple radii, the scroll-liner sections of the present invention have constant-radius curved sections that are identical and interchangeable between a number of different positions. Advantageously, this requires fewer spare parts to be on hand for replacing any worn or damaged sections, and therefore reduces inventory and storage costs.

In another aspect, whereas existing fan housings have large removable "pie" sections that include portions of the housing sideplates, the removable scroll-liner sections of the present invention are much smaller, and more manoeuvrable. Advantageously, these smaller parts are handled more easily, and do not require large lifting equipment (of the type required for "pie" section removal), thereby significantly reducing costs associated with maintenance repairs.

Other features and advantages of the present invention will become apparent from the following detailed description and accompanying drawings. It should be understood, however, that the detailed description and specific examples are given by way of illustration and not limitation. Many modifications and changes within the scope of the present invention may be made without departing from the spirit thereof, and the invention includes all such modifications.

Figure 1:
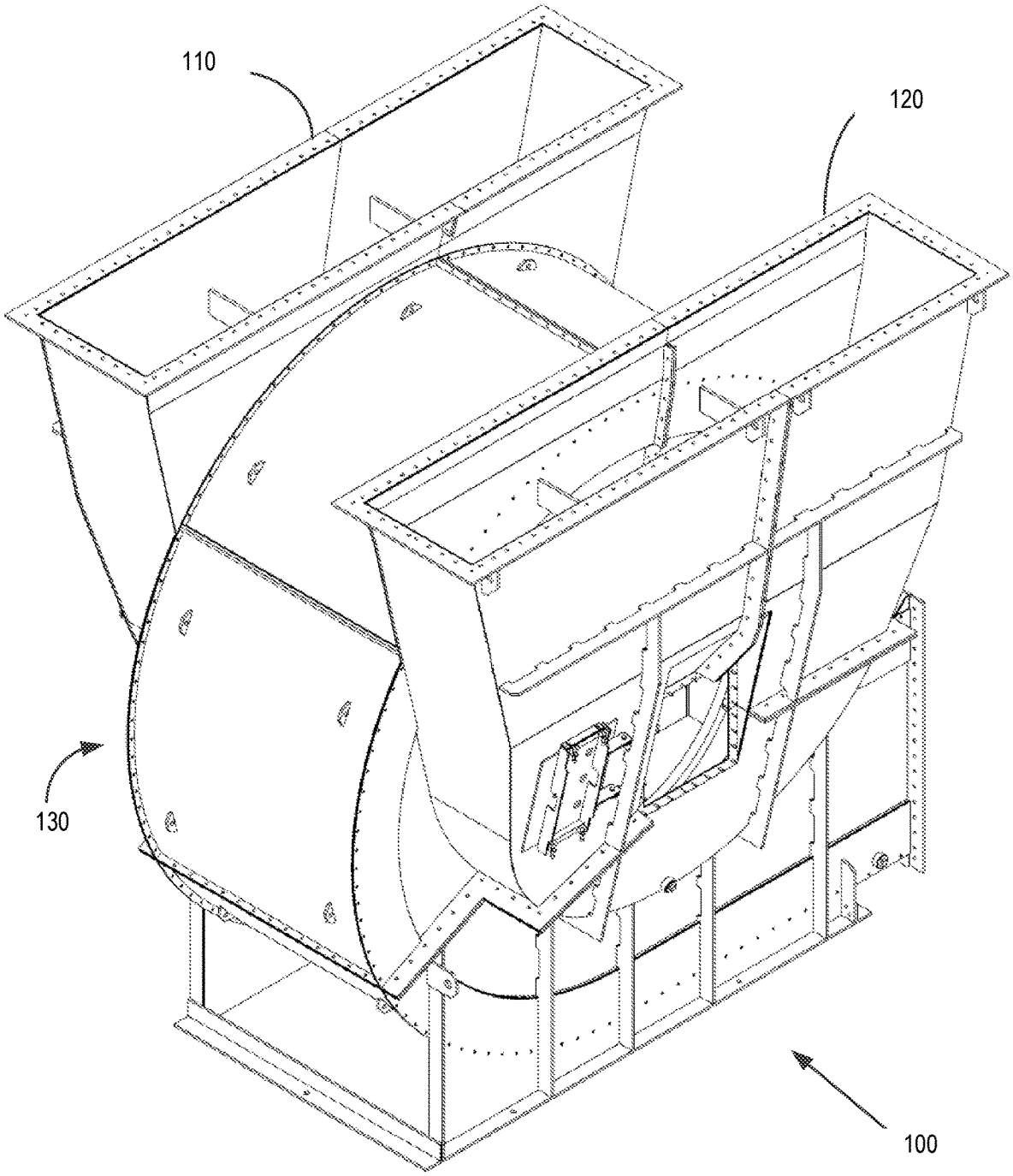
FIG. 1 shows a perspective view of an industrial fan housing assembly in accordance with an illustrative embodiment.

In the drawings, embodiments of the invention are illustrated by way of example. It is to be expressly understood that the description and drawings are only for the purpose of illustration and as an aid to understanding and are not intended as a definition of the limits of the invention.

DETAILED DESCRIPTION

As noted above, the present disclosure relates generally to industrial fan housing assemblies, and more particularly to fan housing assemblies having a plurality of scroll-liner sections which may be assembled together with fan housing scroll sideplates or rims.

In an embodiment, each scroll-liner section comprises a generally curved plate having edge flanges on either side. The edge flanges include a plurality of apertures which are aligned with corresponding apertures provided on the fan housing scroll sideplates. Each scroll-liner section may therefore be bolted onto the rims using a plurality of suitably sized bolts.

As each scroll-liner section may be over 10 feet across and over 15 feet along the length of on the fan housing scroll sideplates its curved sides, each scroll-liner section also includes a plurality of attachment points for moving these scroll-liner sections into position with powered overhead lifting equipment.

In order to create at least a partial air seal between each scroll-liner section and the rims, a continuous seal is fitted at the location where each scroll-liner section attaches to the fan housing scroll sideplates.

As each scroll-liner section is installed and removed individually by bolting each section to the sideplates, the sections do not require welding and/or cutting.

Advantageously, the fan housing assembly comprises easily removable sections which allow access to the inner of the fan housing, and therefore provides a safer working environment by avoiding confined space entry.

Furthermore, as sections do not need to be welded, the use of hot welding or torching tools is not required to complete maintenance.

Because the scroll-liner sections can be removed completely from the exterior of the fan housing (enclosure), the fan rotor does not need to be removed, as is the case for certain types of interior maintenance.

Whereas existing fan housing liners may be repaired in situ only, or replaced by cutting and welding, with the current invention, each scroll-liner section has a liner built into the section, such that liners do not need to be removed from inside the fan housing. This greatly reduces the time required to remove and replace worn or damaged linings. This facilitates maintenance during more frequently available short-duration plant outages. The advantage of this is significantly reduced production down-time for maintenance, and timely maintenance of components when required instead of allowing parts to wear out because of the need to wait to wait until longer outage times can be scheduled.

In another aspect, whereas existing fan housing liners are curved with variable or multiple radii, the scroll-liner sections of the present invention have constant radius curved sections that are identical and interchangeable between a number of different positions. Advantageously, this requires fewer spare parts to be on hand for replacing any worn or damaged sections, and therefore reduces inventory and storage costs.

In another aspect, whereas existing fan housings have large removable "pie" sections that include portions of the housing sideplates, the removable scroll-liner sections of the present invention are much smaller, and more manoeuvrable. Advantageously, these smaller parts are handled more easily, and do not require large lifting equipment, thereby significantly reducing costs associated with maintenance repairs.

Illustrative embodiments will now be described with reference to the drawings.

Now referring to FIG. 1, shown is a perspective view of an industrial fan housing assembly 100 in accordance with an illustrative embodiment. As shown, the fan housing assembly 100 includes a first fan housing sideplate 110, a second fan housing sideplate 120, and removable scroll-liner sections 130 therebetween.

Figure 2:
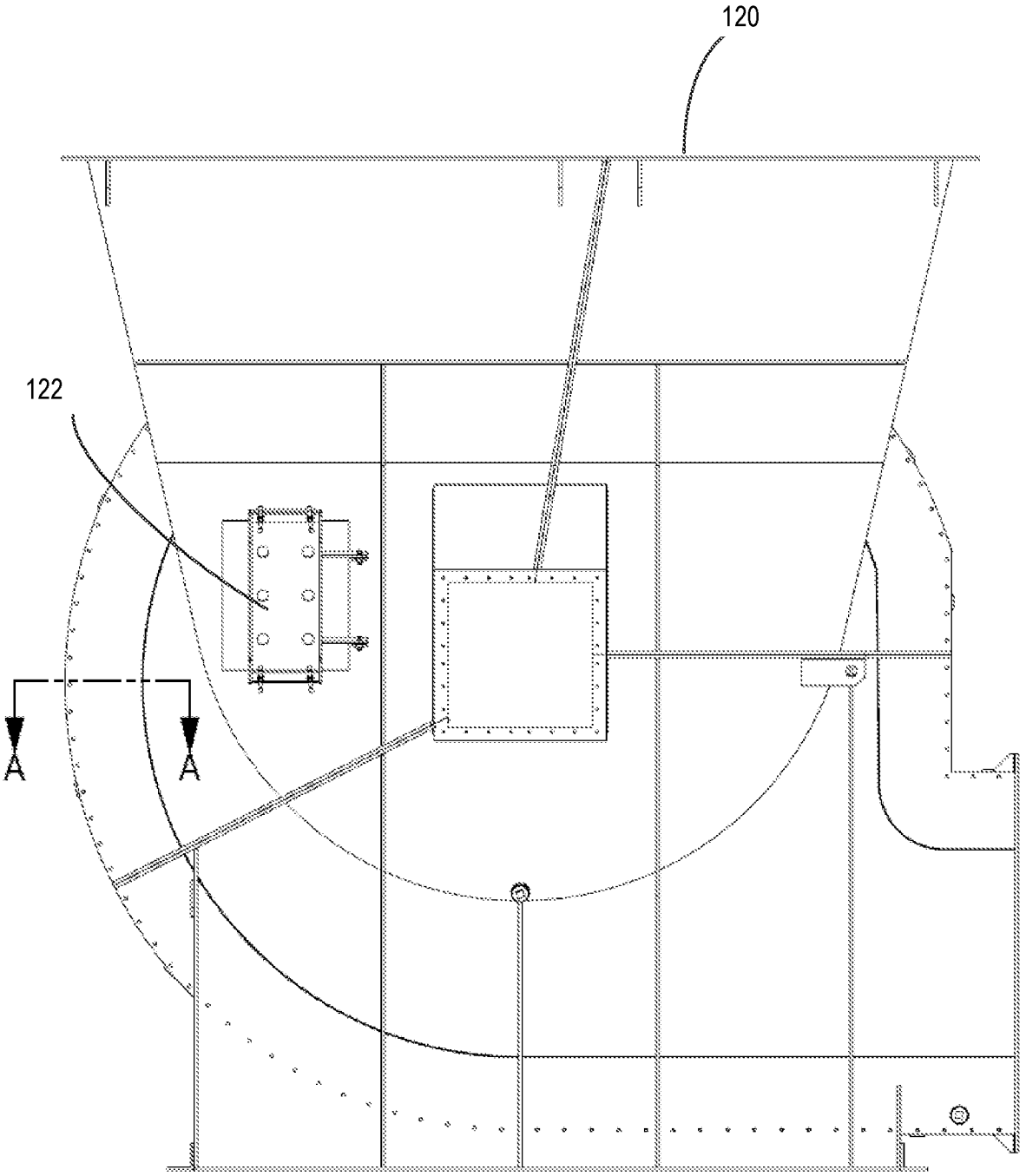
FIG. 2 shows a side view of the industrial fan housing assembly of FIG. 1.

FIG. 2 shows a side view of the second fan housing sideplate 120 of FIG. 1, including an access hatch 122 providing access to personnel. This access hatch 122 provides an illustration of the scale of the second fan housing sideplate 120, which may be 30 feet in height or more, for example.

Figure 3:
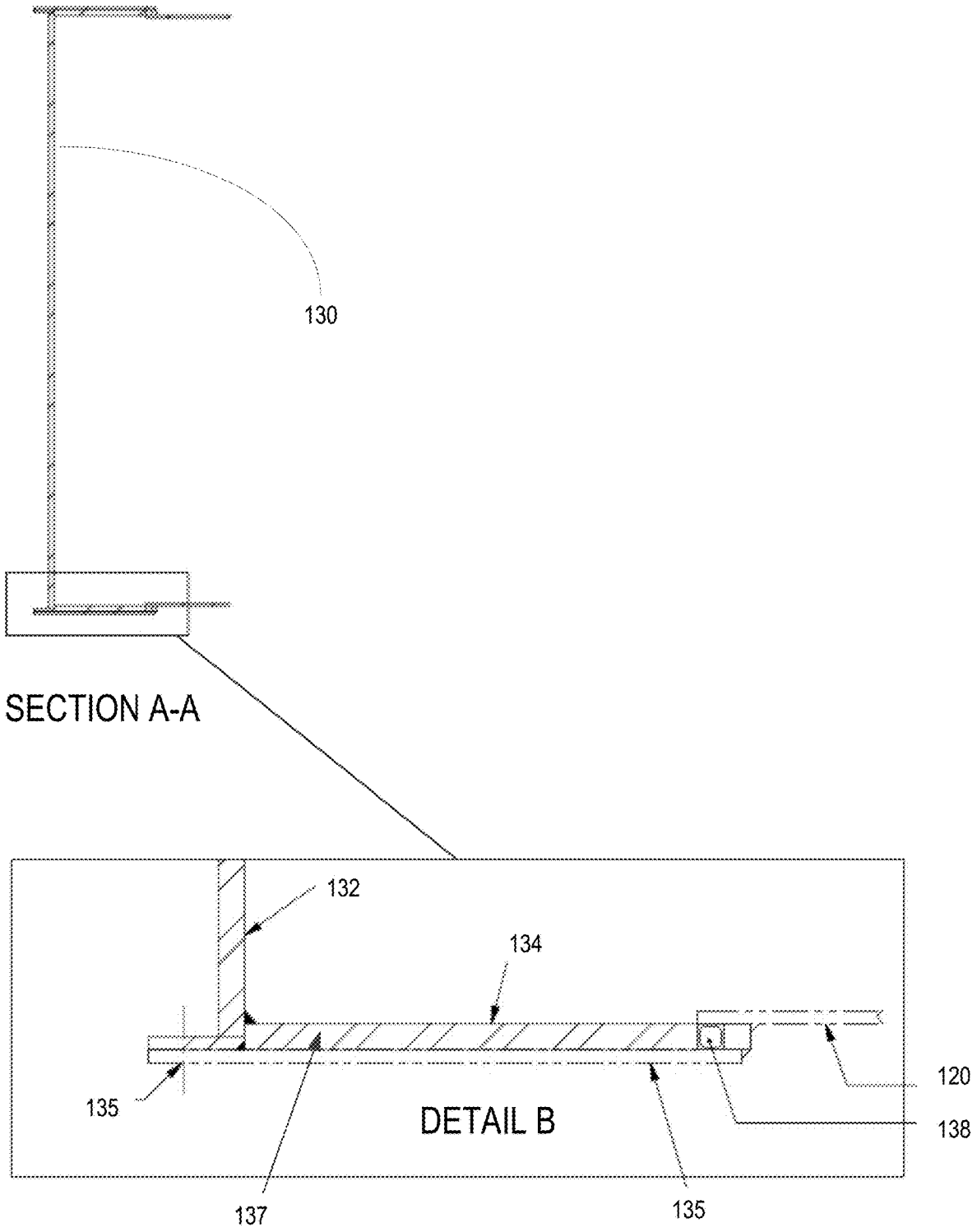
FIG. 3 shows a cross-sectional view of a portion of a scroll-liner section taken at line A-A of FIG. 2, and a more detailed view showing the scroll-liner section bolted onto a section of the fan housing scroll sideplate.

Now referring to FIG. 3, shown is a cross-sectional view of a portion of a scroll-liner section 130 taken at line A-A of FIG. 2. As shown in the detailed view (DETAIL B), the scroll-liner section 130 includes a replaceable scroll section overlay plate outer scroll 132, and a replaceable scroll section overlay plate skirt liner 134 on a side flange 137. The scroll-liner section 130 is bolted on to a fan housing scroll sideplate extension or "side flange" 135 which forms part of second fan housing sideplate 120. A continuous silicone rope seal 138 fits in a fan housing sideplate recess and engages with the replaceable scroll section overlay plate skirt liner 134 and side flange 137 to form a seal. A small section of the fan housing scroll sideplate 120 is also shown.

Figure 4:
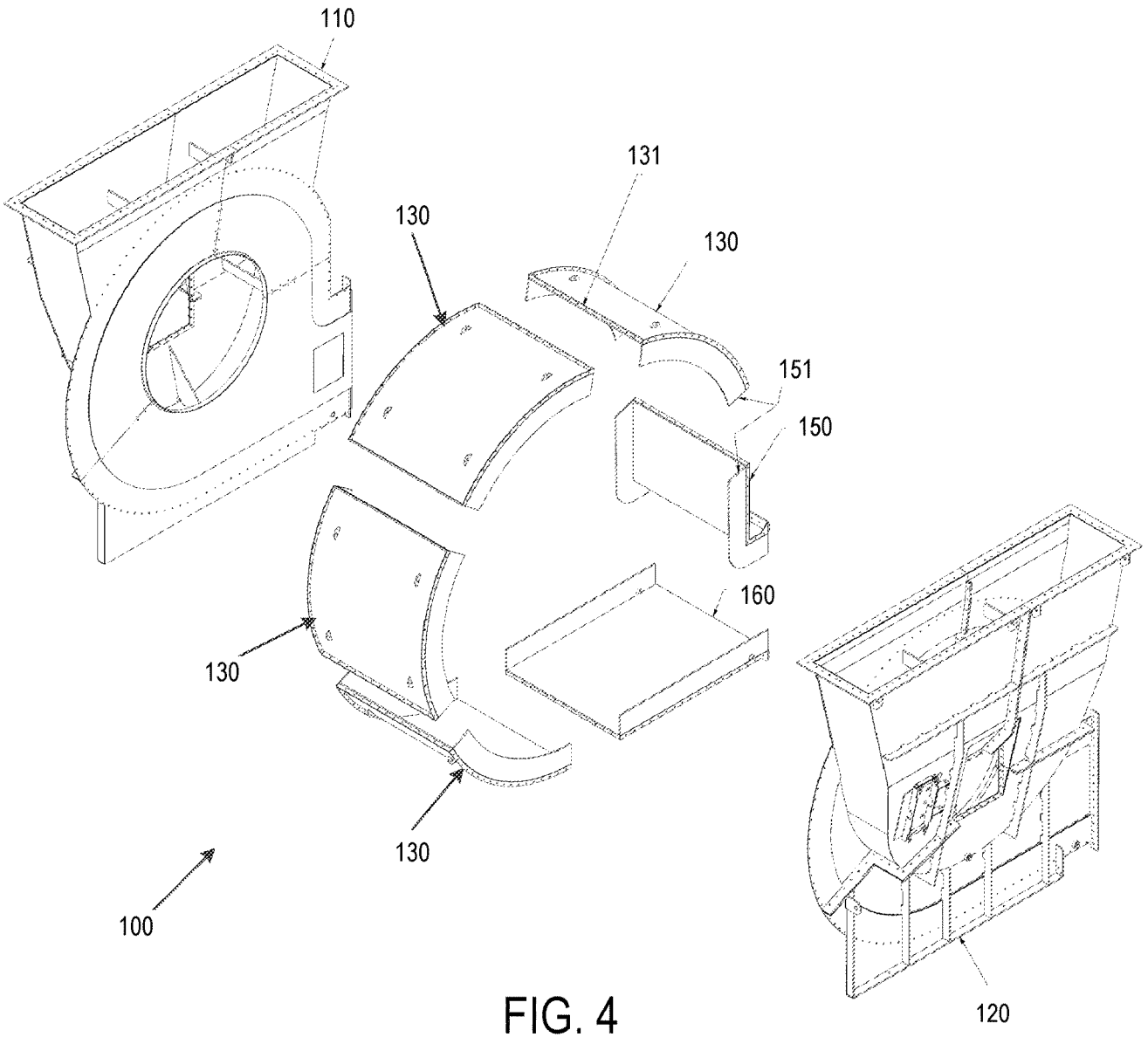
FIG. 4 shows an exploded view of the industrial fan housing assembly of FIG. 1, including scroll-liner sections that are assembled together to form the mid-section of the industrial fan housing.

Now referring to FIG. 4, shown is an exploded view of the industrial fan housing assembly 100 of FIG. 1, including a plurality of scroll-liner sections 130, 150, 160 that are assembled together to form the mid-section of the industrial fan housing 100.

As shown, for of the sections 130 are identical and interchangeable. Advantageously, this requires fewer spare parts to be on hand for replacing any worn or damaged sections, and therefore reduces inventory and storage costs.

A replaceable scroll cut off section 150 and a replaceable scroll outlet section 160 are adapted to be assembled to the scroll-liner sections 130 at their beveled outside edges 151, which may be assembled together by bolts. Silicone caulking or silicone rope seal 138 may be used to form a seal at the edges of the sections when they are mounted end-to-end.

Figure 5:
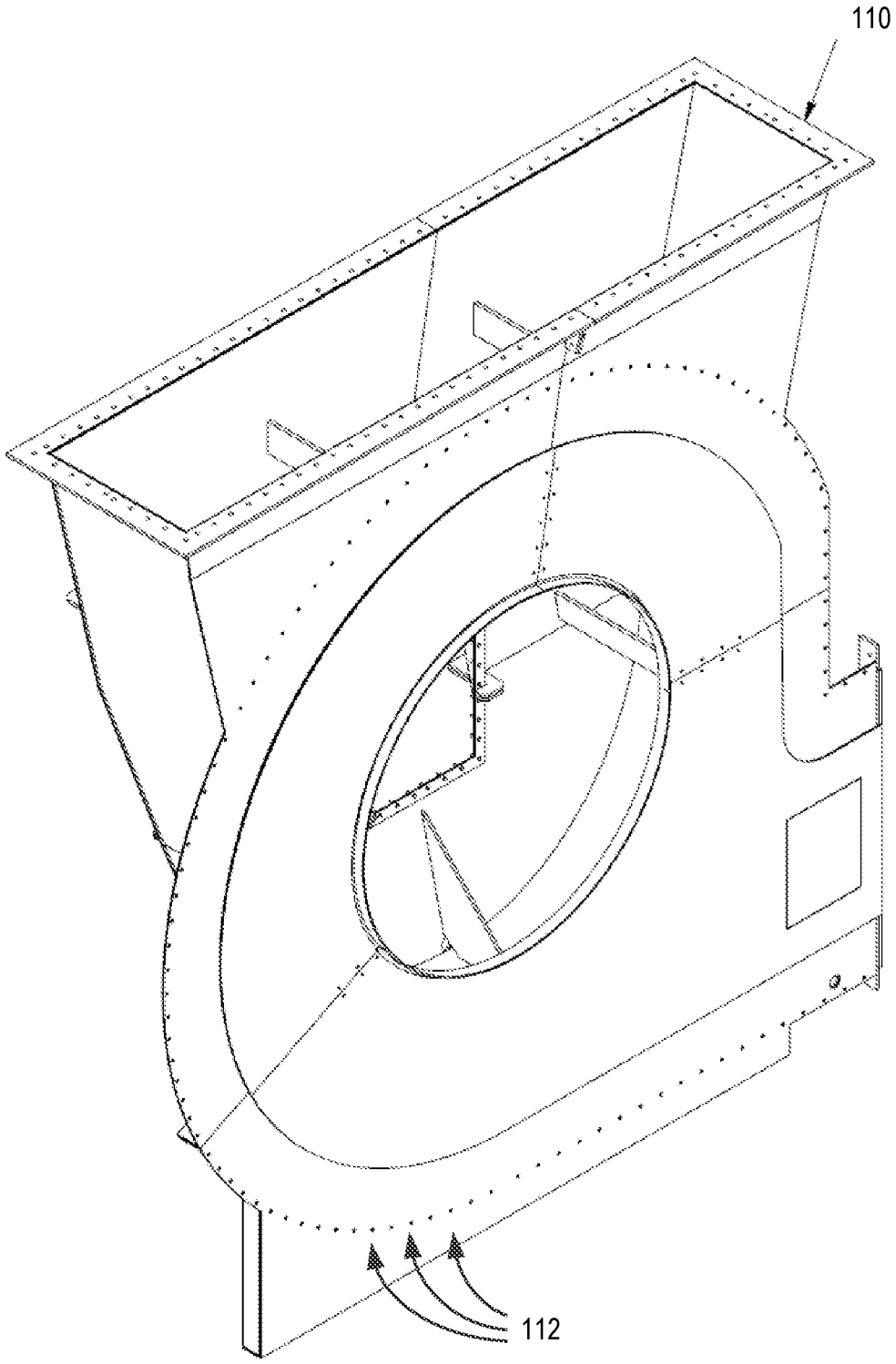
FIG. 5 shows an enlarged view of a first fan housing scroll sideplate in accordance with an illustrative embodiment.

Now referring to FIG. 5, shown is an enlarged view of a first fan housing scroll sideplate 110 in accordance with an illustrative embodiment. As shown, the first fan housing scroll sideplate 110 includes a plurality of apertures which may receive bolts to bolt the scroll-liner sections 130, 150, 160 into position. Once all sections are assembled, the sections 130, 150, 160 form the midsection of the complete fan housing assembly 100 of FIG. 1.

Figure 6:
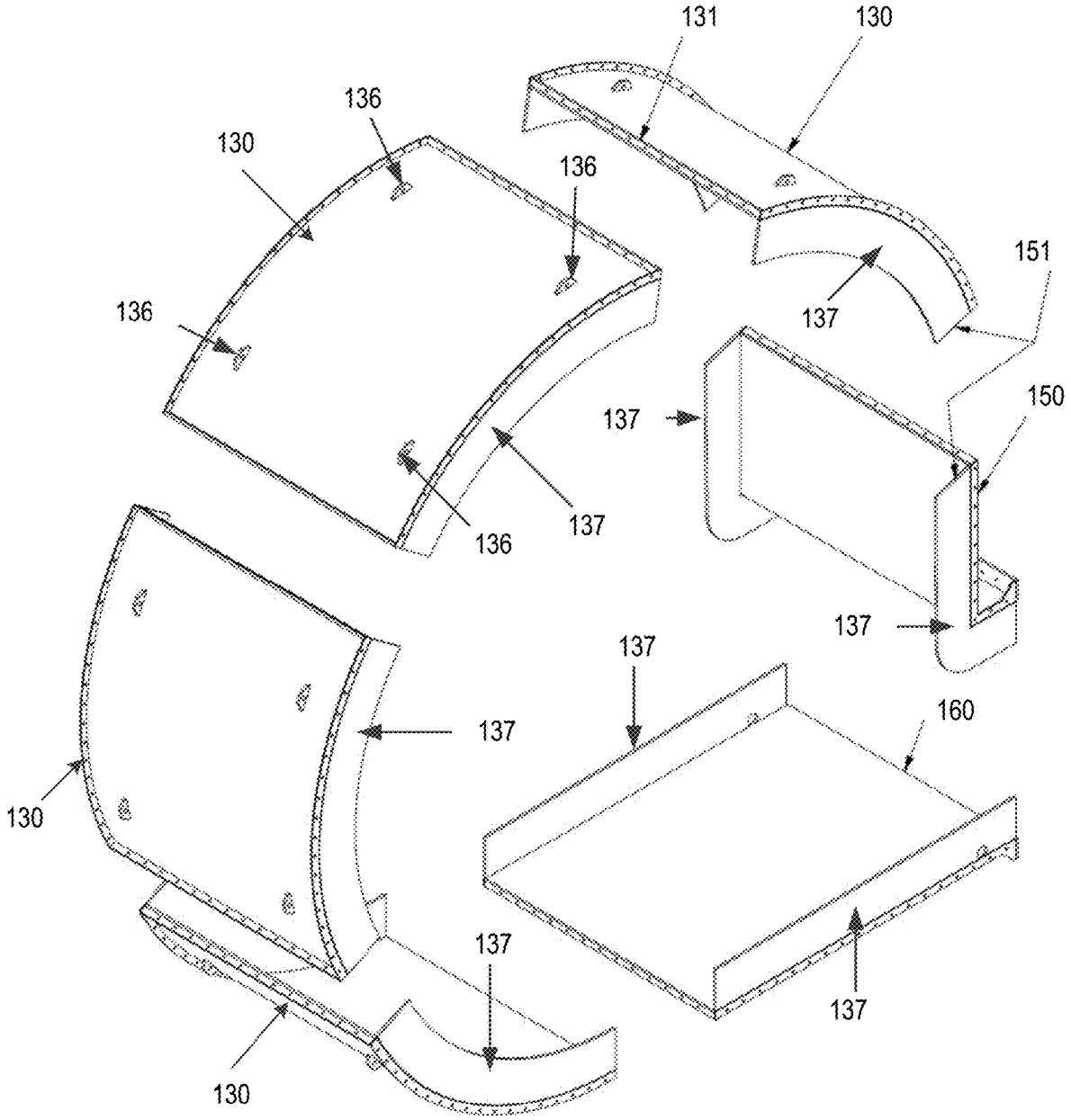
FIG. 6 shows an enlarged view of a plurality of scroll-liner sections that are assembled together to form the mid-section of the industrial fan housing.

Now referring to FIG. 6, shown is an enlarged view of the scroll-liner sections 130, 150, 160 that are assembled together to form the mid-section of the industrial fan housing 100. Once again, four of the sections 130 are identical and interchangeable. However, it will be appreciated that these sections could be smaller or larger. For example, each section 130 may be splits in half to have eight identical and interchangeable sections. These smaller sections may be utilized for larger fan housing assemblies in which each section needs to be under a given weight to be easy enough to lift and to place in position for assembly. Each scroll-liner section 130 includes an overlay plate skirt liner 134 and side flange 137 to provide structural strength and rigidity to each section 130. These overlay plate skirt liners 134 and side flange 137 also position the sections 130 properly for sealing and mounting to the first and second fan housing scroll sideplates, as previously shown in the detail view of FIG. 3. Each scroll-liner section 130 also includes positioning flanges 136 for lifting or lowering each section 130 for mounting or for removal.

Advantageously, as anyone of these sections may be removed on their own, access to the fan housing assembly 100 can be achieved from multiple different positions and angles.

Figure 7:
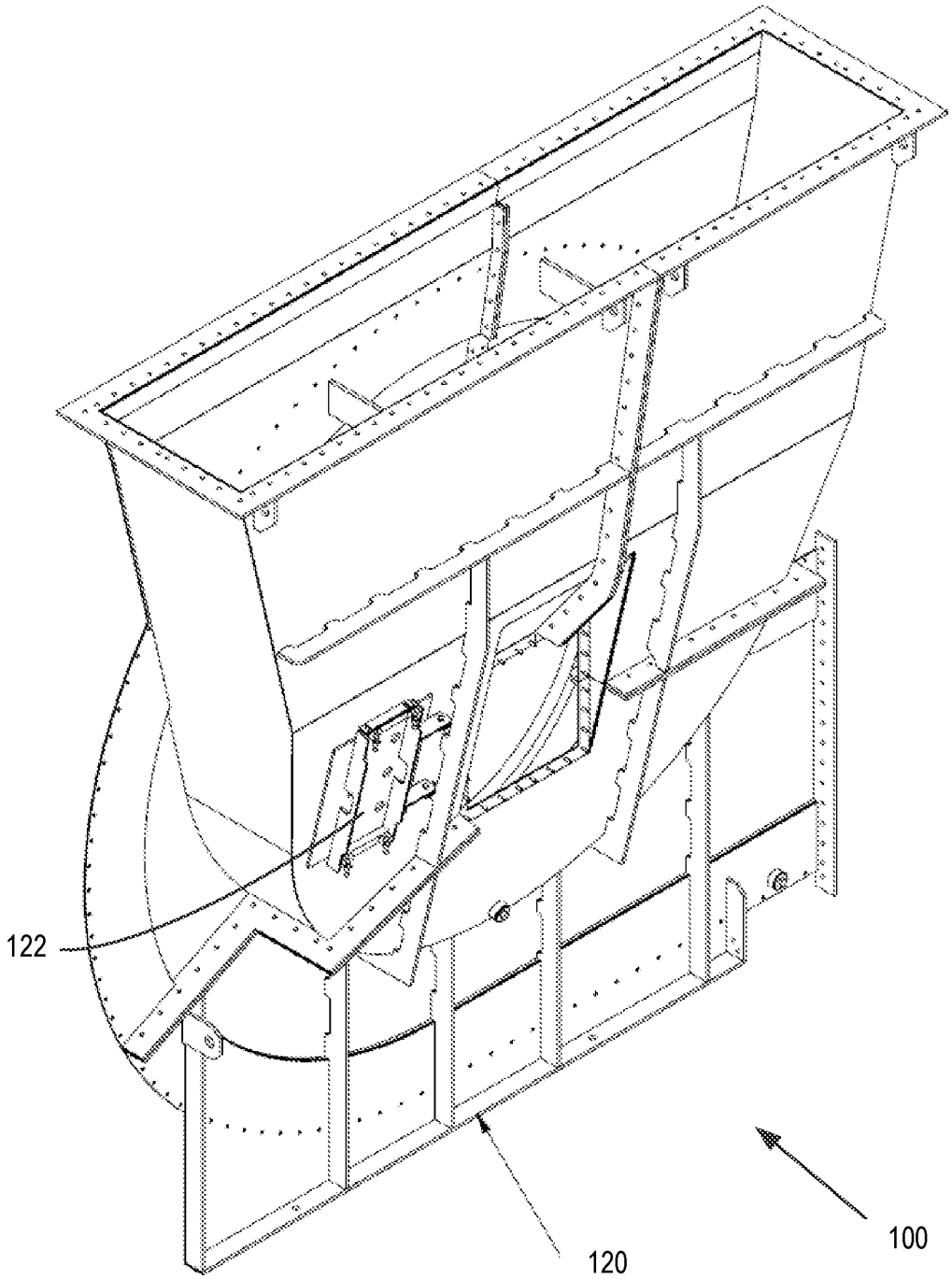
FIG. 7 shows an enlarged view of a second fan housing scroll sideplate in accordance with an illustrative embodiment.

FIG. 7 shows an enlarged view of a second fan housing scroll sideplate 120 in accordance with an illustrative embodiment, as previously described. Access hatch 122 is provided on the outside of sideplate 120, providing access within the sideplate assembly 120.

Thus, in an aspect, there is provided an industrial fan housing assembly, comprising a plurality of scroll-liner sections configured to be assembled together to form a midsection between first and second fan housing scroll sideplates on either side of the industrial fan housing assembly, each scroll-liner section including a liner on its inner facing surface; wherein, each scroll-liner section includes side flanges adapted to be mountable to the first and second fan housing scroll sideplates on either side.

In an embodiment, at least some of the scroll-liner sections are identical and interchangeable, thereby allowing the identical and interchangeable sections to be mounted in one of a plurality of positions.

In another embodiment, each of the scroll-liner sections are individually removable to provide access to the fan housing assembly for maintenance.

In another embodiment, each of the scroll-liner sections are individually replaceable to replace a section of the worn liner.

In another embodiment, each of the plurality of scroll-liner sections includes beveled edges to receive a caulking or rope seal along the beveled edges when assembled edge-to-edge.

In another embodiment, each of the side flanges are adapted to abut a caulking or rope seal to seal the side flanges to first and second fan housing scroll sideplates on either side when mounted.

In another embodiment, the first and second fan housing scroll sideplates include a plurality of apertures in the side flanges positioned to align with corresponding apertures of each of the scroll-liner sections, such that the scroll-liner sections may be bolted into position without welding or cutting.

In another embodiment, each scroll-liner section includes an overlay plate skirt liner to provide structural strength and rigidity to each section.

In another embodiment, the overlay plate skirt liner is adapted to properly position each scroll-liner section for sealing and mounting to the first and second fan housing scroll sideplates.

In another embodiment, each scroll-liner section includes a plurality of positioning flanges for lifting or lowering each section during mounting or removal.

In another aspect, there is provided an apparatus for an industrial fan housing assembly, comprising: a section of a scroll-liner configured to be assembled together with one or more other sections to form a midsection between first and second fan housing scroll sideplates on either side of the industrial fan housing assembly, each scroll-liner section including a liner on its inner facing surface; wherein, each scroll-liner section includes side flanges adapted to be mountable to the first and second fan housing scroll sideplates on either side.

In an embodiment, the section includes a beveled edge to receive a caulking or rope seal the edges when assembled edge-to-edge together with other sections.

In another embodiment, each of the side flanges are adapted to abut a caulking or rope seal to seal the side flanges to first and second fan housing scroll sideplates on either side when mounted.

In another embodiment, each section includes a plurality of apertures corresponding to apertures provided on the fan housing scroll sideplates for assembly via bolts.

In another embodiment, the first and second fan housing scroll sideplates include a plurality of apertures in the side flanges positioned to align with corresponding apertures of each of the scroll-liner sections, such that the scroll-liner sections may be bolted into position without welding or cutting.

In another embodiment, each scroll-liner section includes an overlay plate skirt liner to provide structural strength and rigidity to each section.

In another embodiment, the overlay plate skirt liner is adapted to properly position each scroll-liner section for sealing and mounting to the first and second fan housing scroll sideplates.

In another embodiment, each scroll-liner section includes a plurality of positioning flanges for lifting or lowering each section during mounting or removal.

While various embodiments and illustrative examples have been described above, it will be appreciated that these embodiments and illustrative examples are not limiting, and the scope of the invention is defined by the following claims.

The invention claimed is:

1. An industrial fan housing assembly, comprising: a plurality of scroll-liner sections configured to be assembled together to form a midsection between first and second fan housing scroll sideplates on either side of the industrial fan housing assembly, each scroll-liner section including a liner on its inner facing surface; wherein, each scroll-liner section includes side flanges adapted to be mountable to the first and second fan housing scroll sideplates on either side; and wherein at least some of the scroll-liner sections are identical and interchangeable, thereby allowing the identical and interchangeable sections to be mounted in one of a plurality of positions.

2. The industrial fan housing assembly of claim 1, wherein each of the scroll-liner sections are individually removable to provide access to the fan housing assembly for maintenance.

3. The industrial fan housing assembly of claim 1, wherein each of the scroll-liner sections are individually replaceable to replace a section of the worn liner.

4. The industrial fan housing assembly of claim 1, wherein each of the plurality of scroll-liner sections includes beveled edges to receive a caulking or rope seal along the beveled edges when assembled edge-to-edge.

5. The industrial fan housing assembly of claim 1, wherein each of the side flanges are adapted to abut a caulking or rope seal to seal the side flanges to first and second fan housing scroll sideplates on either side when mounted.

6. The industrial fan housing assembly of claim 1, wherein the first and second fan housing scroll sideplates include a plurality of apertures in a respective first and second fan housing scroll side flange positioned to align with corresponding apertures of each of the scroll-liner sections, such that the scroll-liner sections may be bolted into position without welding or cutting.

7. The industrial fan housing assembly of claim 6, wherein each scroll-liner section includes an overlay plate skirt liner to provide structural strength and rigidity to each section.

8. The industrial fan housing assembly of claim 7, wherein the overlay plate skirt liner is adapted to properly position each scroll-liner section for sealing and mounting to the first and second fan housing scroll sideplates.

9. The industrial fan housing assembly of claim 6, wherein each scroll-liner section includes a plurality of positioning flanges for lifting or lowering each section during mounting or removal.

10. An apparatus for an industrial fan housing assembly, comprising: a plurality of sections of a scroll-liner configured to be assembled together to form a midsection between first and second fan housing scroll sideplates on either side of the industrial fan housing assembly, each scroll-liner section including a liner on its inner facing surface; wherein, each scroll-liner section includes side flanges adapted to be mountable to the first and second fan housing scrod sideplates on either side; and wherein at least some of the plurality of sections of a scroll-liner are identical and interchangeable, thereby allowing the identical and interchangeable sections to be mounted in one of a plurality of positions.

11. The apparatus of claim 10, further wherein the section includes a beveled edge to receive a caulking or rope seal the edges when assembled edge-to-edge together with other sections.

12. The apparatus of claim 10, wherein each of the side flanges are adapted to abut a caulking or rope seal to seal the side flanges to first and second fan housing scroll sideplates on either side when mounted.

13. The apparatus of claim 10, wherein each section includes a plurality of apertures corresponding to apertures provided on the fan housing scroll sideplates for assembly via bolts.

14. The apparatus of claim 10, wherein the first and second fan housing scroll sideplates include a plurality of apertures in a respective first and second fan housing scroll side flanges positioned to align with corresponding apertures of each of the scroll-liner sections, such that the scroll-liner sections may be bolted into position without welding or cutting.

15. The apparatus of claim 10, wherein each scroll-liner section includes an overlay plate skirt liner to provide structural strength and rigidity to each section.

16. The apparatus of claim 10, wherein the overlay plate skirt liner is adapted to properly position each scroll-liner section for sealing and mounting to the first and second fan housing scroll sideplates.

17. The apparatus of claim 10, wherein each scroll-liner section includes a plurality of positioning flanges for lifting or lowering each section during mounting or removal.

* * * * *